US010092070B1

(12) United States Patent
Boys et al.

(10) Patent No.: US 10,092,070 B1
(45) Date of Patent: Oct. 9, 2018

(54) HANDBAG AND ASSOCIATED METHOD

(71) Applicant: Cole Haan LLC, New York City, NY (US)

(72) Inventors: Jack Boys, New York City, NY (US); Ann Bono, New York City, NY (US); Anna Lu, New York City, NY (US)

(73) Assignee: COLE HAAN LLC, New York City, NY (US)

( * ) Notice: Subject to any disclaimer, the term of this patent is extended or adjusted under 35 U.S.C. 154(b) by 0 days.

(21) Appl. No.: 15/812,168

(22) Filed: Nov. 14, 2017

Related U.S. Application Data

(60) Provisional application No. 62/579,683, filed on Oct. 31, 2017.

(51) Int. Cl.
*A45C 3/06* (2006.01)
*A45C 3/00* (2006.01)

(52) U.S. Cl.
CPC ..... *A45C 3/001* (2013.01); *A45C 3/06* (2013.01)

(58) Field of Classification Search
CPC ..... A45C 13/001; A45C 3/001; A45C 3/06
USPC ..... 150/127
See application file for complete search history.

(56) References Cited

U.S. PATENT DOCUMENTS 4,196,534 A * 4/1980 Shibamoto ..... B65D 29/04 383/117
5,366,293 A * 11/1994 Lii ..... A45C 9/00 383/117
2005/0172402 A1* 8/2005 Uretzky-Miller ..... A45F 3/02 5/417
2017/0022640 A1* 1/2017 Schenk ..... A45F 3/04

FOREIGN PATENT DOCUMENTS

SU 577267 A * 11/1977

* cited by examiner

*Primary Examiner* — Sue A Weaver
(74) *Attorney, Agent, or Firm* — Thompson Coburn LLP

(57) ABSTRACT

A handbag includes a bottom portion and a sidewall portion. The sidewall portion extends up from the bottom portion and includes at least a first knitted element. The first knitted element is of a unitary one-piece construction formed during a knitting process on a knitting machine, and the knitted element includes at least first and second knitted regions. The first knitted region of the first knitted element is seamlessly knitted with the second knitted region of the first knitted element. The first knitted region of the first knitted element is of a first type of knit structure. The second knitted region of the first knitted element is of a second type of knit structure. The second type of knit structure is different from the first type of knit structure.

29 Claims, 12 Drawing Sheets

HANDBAG AND ASSOCIATED METHOD

CROSS-REFERENCE TO RELATED APPLICATIONS

This application claims the benefit of U.S. Provisional Application Ser. No. 62/579,683, Filed Oct. 31, 2017, which is hereby incorporated by reference in its entirety.

STATEMENT REGARDING FEDERALLY SPONSORED RESEARCH OR DEVELOPMENT

Not Applicable.

APPENDIX

Not Applicable.

BACKGROUND

This disclosure relates to handbags having a knit construction.

SUMMARY

In one aspect, a handbag includes a bottom portion and a sidewall portion. The sidewall portion extends up from the bottom portion and includes at least a first knitted element. The first knitted element is of a unitary one-piece construction formed during a knitting process on a knitting machine, and the knitted element includes at least first and second knitted regions. The first knitted region of the first knitted element is seamlessly knitted with the second knitted region of the first knitted element. The first knitted region of the first knitted element is of a first type of knit structure. The second knitted region of the first knitted element is of a second type of knit structure. The second type of knit structure is different from the first type of knit structure.

In another aspect, a method of constructing a handbag includes stitching or otherwise securing a bottom portion to a sidewall portion substantially near a bottom edge of the sidewall portion such that the sidewall portion extends up from the bottom portion. The sidewall portion includes at least a first knitted element. The first knitted element is of a unitary one-piece construction, and the knitted element includes at least first and second knitted regions. The first knitted region of the first knitted element is seamlessly knitted with the second knitted region of the first knitted element, and the first knitted region of the first knitted element is of a first type of knit structure. The second knitted region of the first knitted element is of a second type of knit structure. The second type of knit structure is different from the first type of knit structure.

Further features and advantages of the present disclosure, as well as the structure and operation of various embodiments of the present disclosure, are described in detail below with reference to the accompanying drawings.

BRIEF DESCRIPTION OF THE DRAWINGS

The accompanying drawings, which are incorporated in and form a part of the specification, illustrate the embodiments of the present disclosure and together with the description, serve to explain the principles of the disclosure.

DETAILED DESCRIPTION

Figure 1:
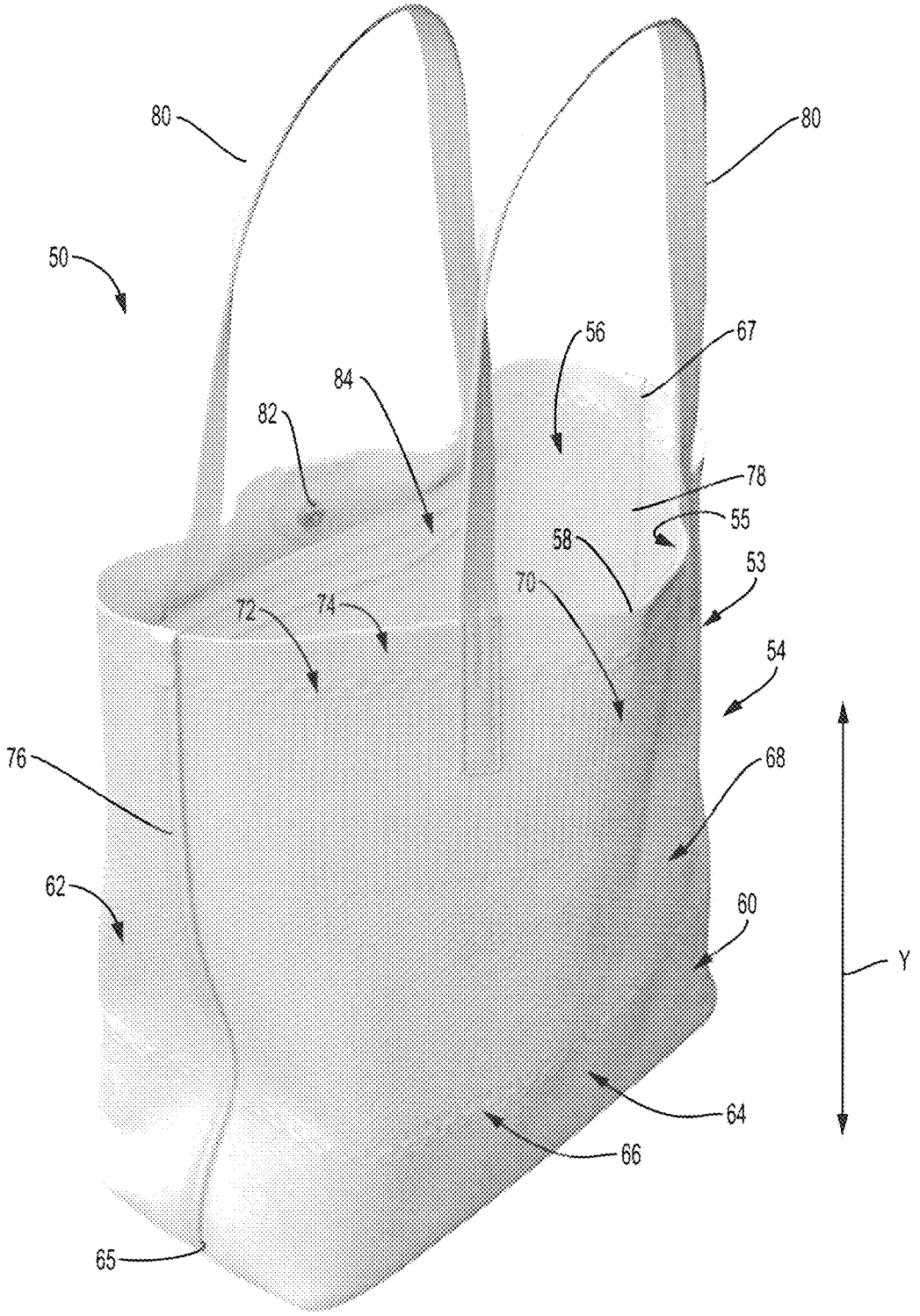
FIG. 1 is a perspective view of a handbag according to one embodiment.
Figure 2:
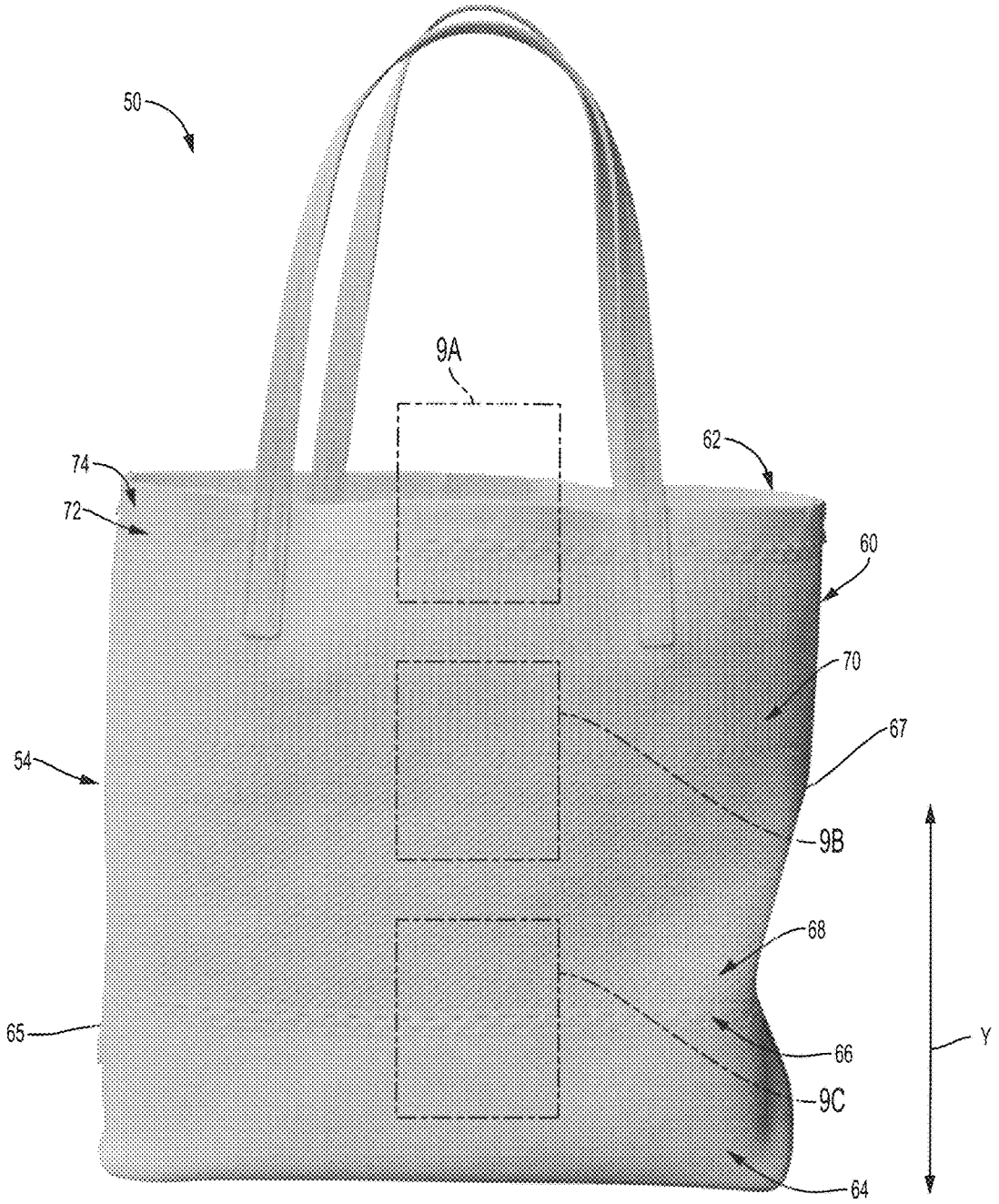
FIG. 2 is a front view of the handbag shown in FIG. 1.
Figure 3:
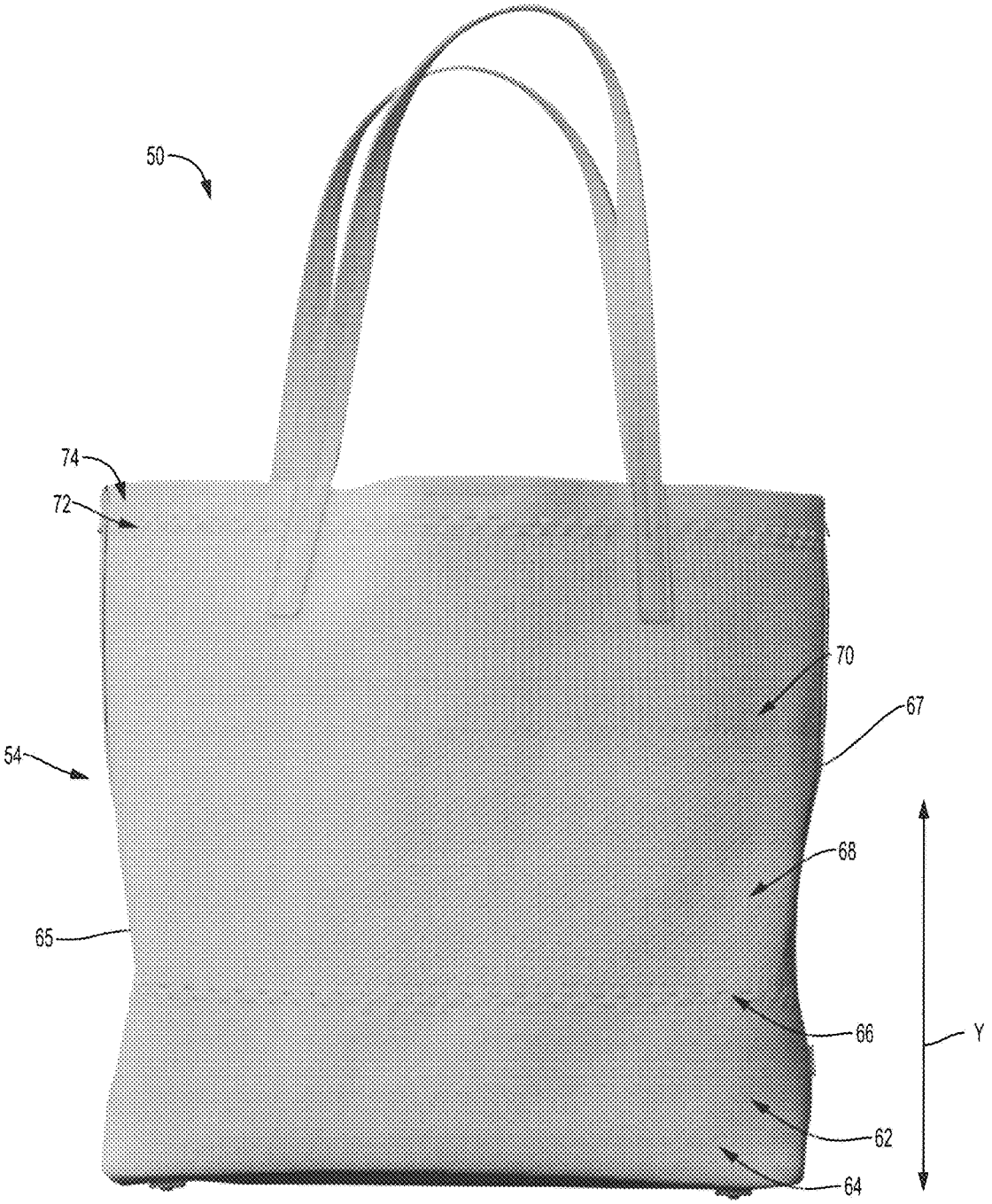
FIG. 3 is a rear view of the handbag shown in FIG. 1.
Figure 4:
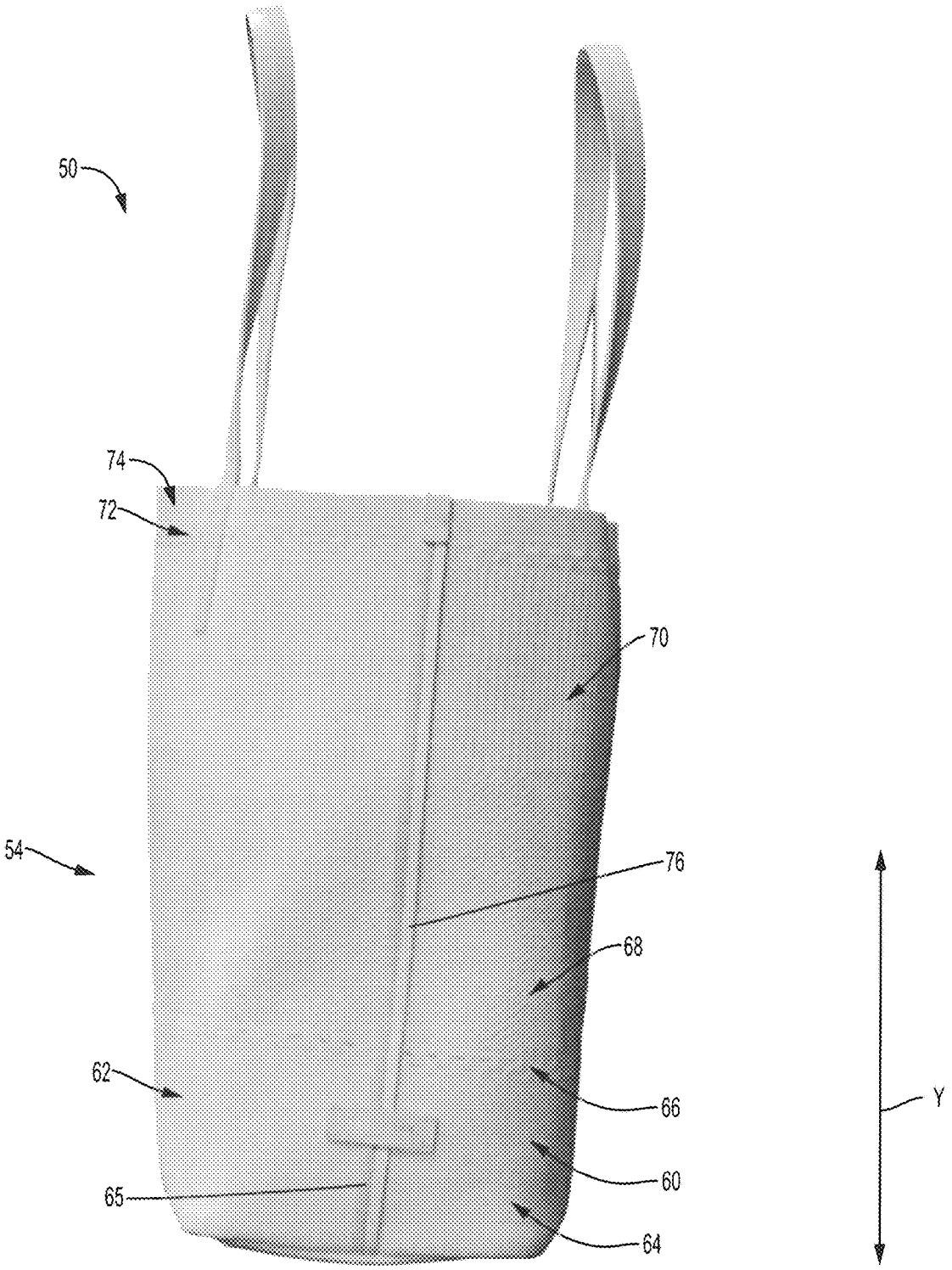
FIG. 4 is a left view of the handbag shown in FIG. 1.
Figure 5:
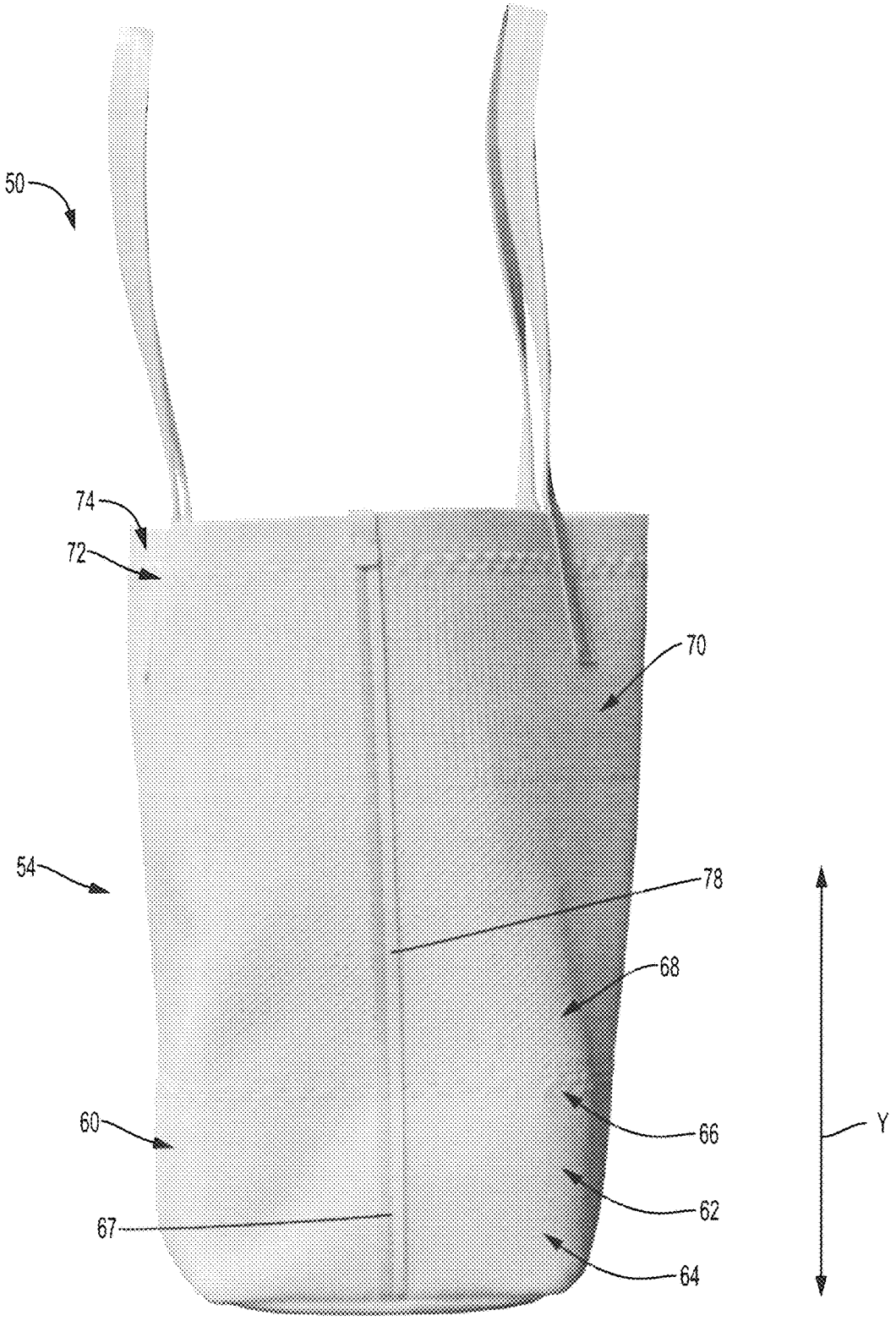
FIG. 5 is a right view of the handbag shown in FIG. 1.
Figure 6:
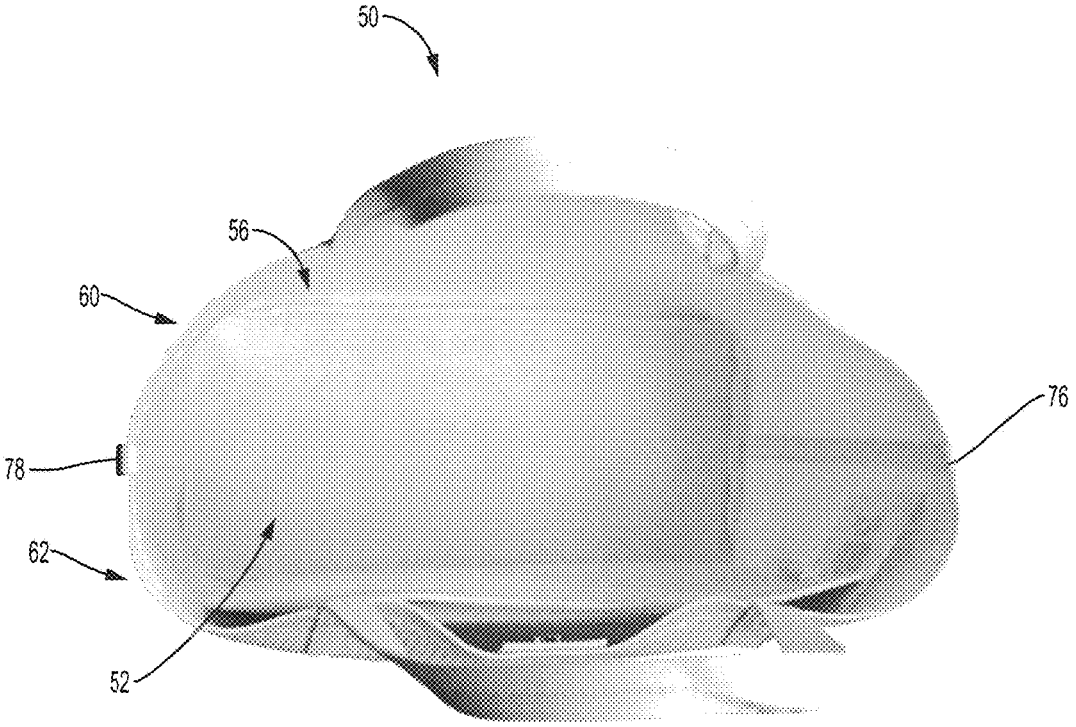
FIG. 6 is a top view of the handbag shown in FIG. 1.
Figure 7:
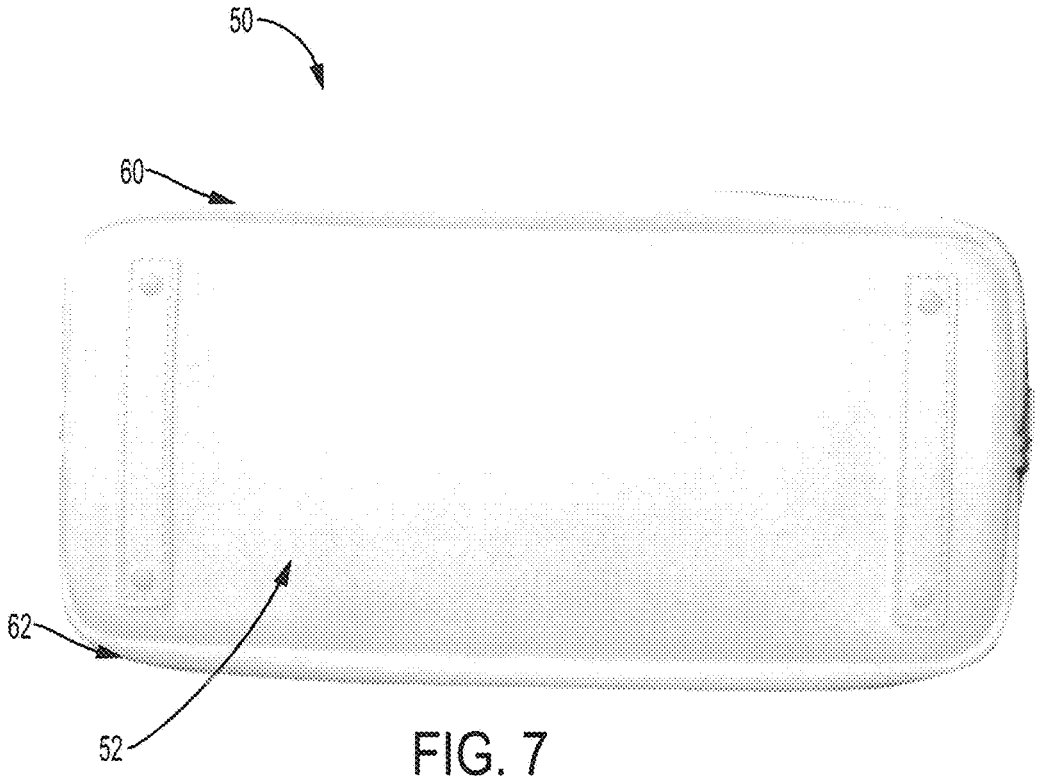
FIG. 7 is a bottom view of the handbag shown in FIG. 1.
Figure 8:
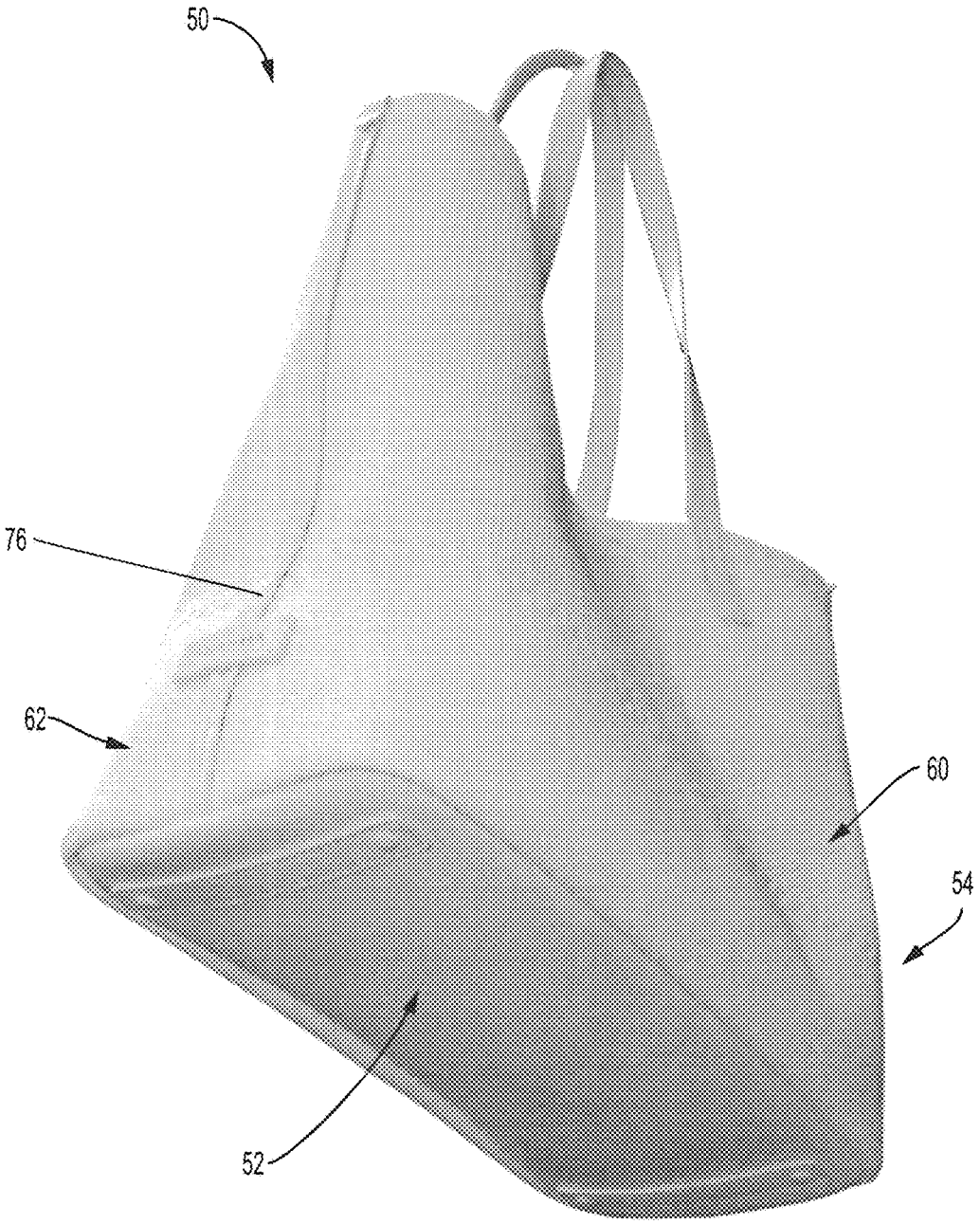
FIG. 8 is a bottom perspective view of the handbag shown in FIG. 1.
Figure 9A:
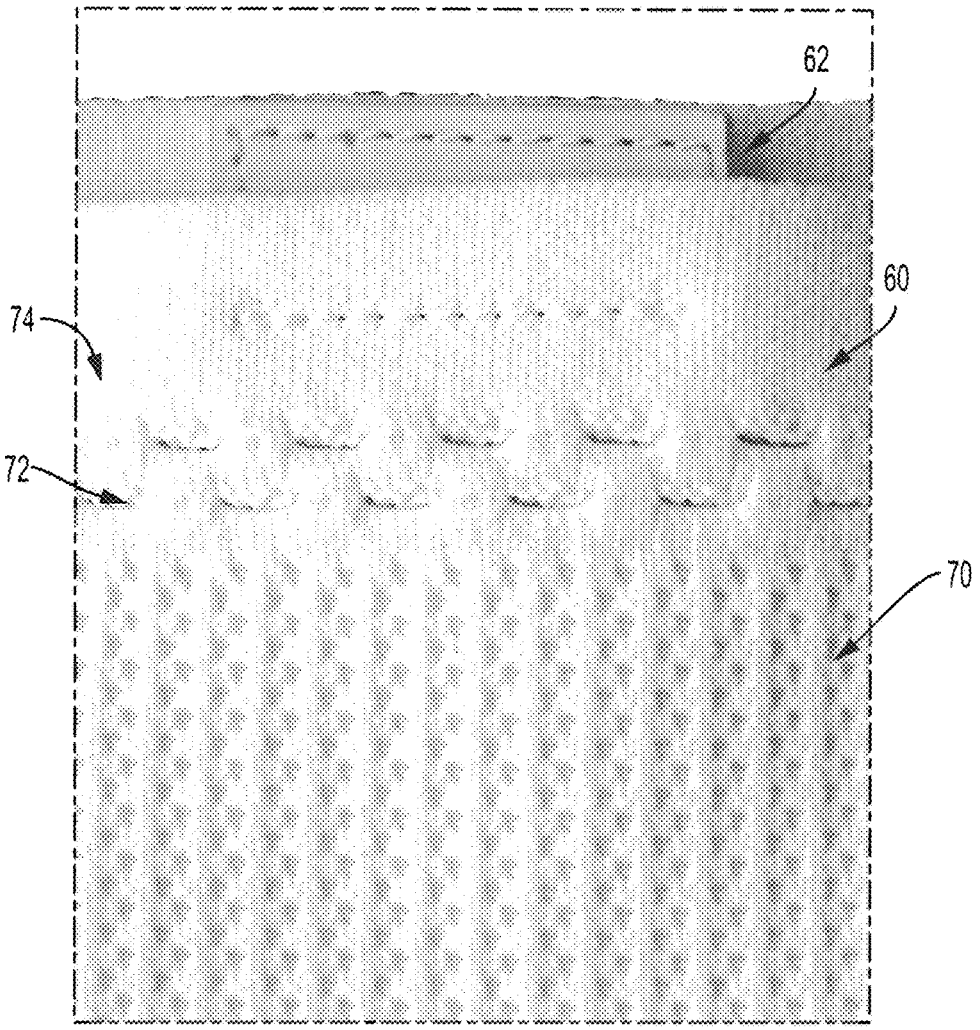
FIG. 9A is a detail view of a first portion of the handbag shown in FIG. 1.
Figure 9B:
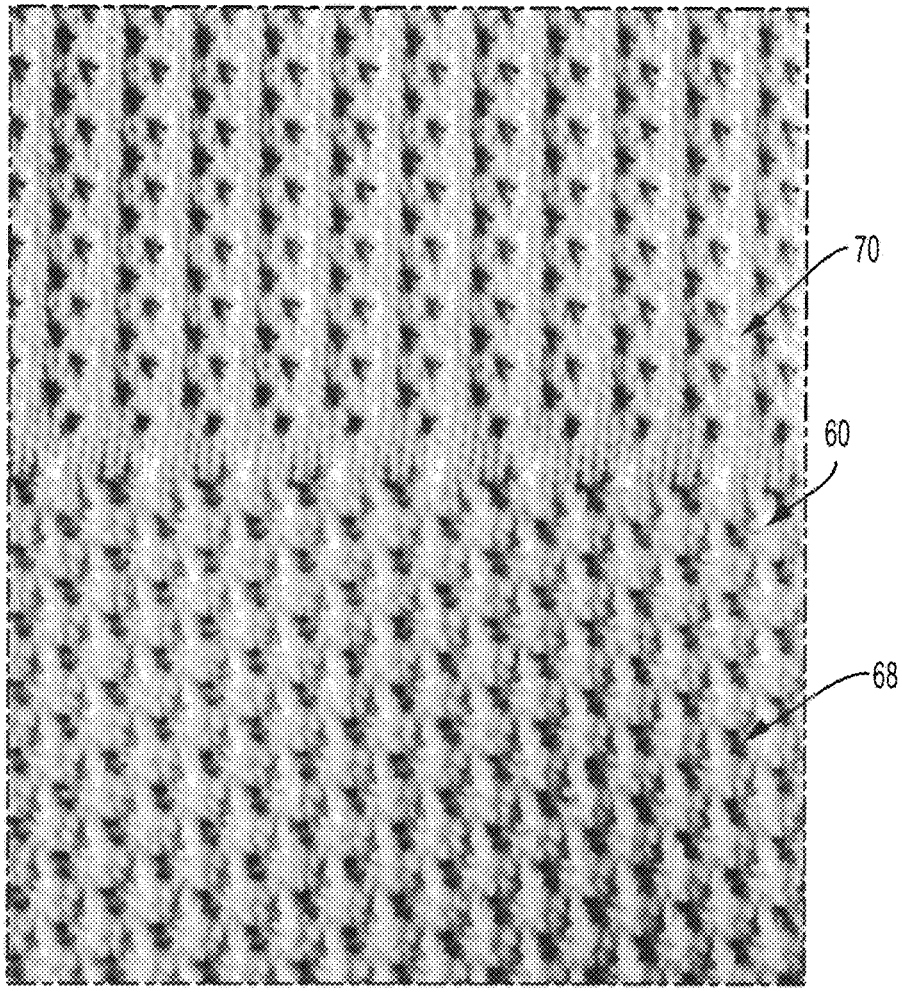
FIG. 9B is a detail view of a second portion of the handbag shown in FIG. 1.
Figure 9C:
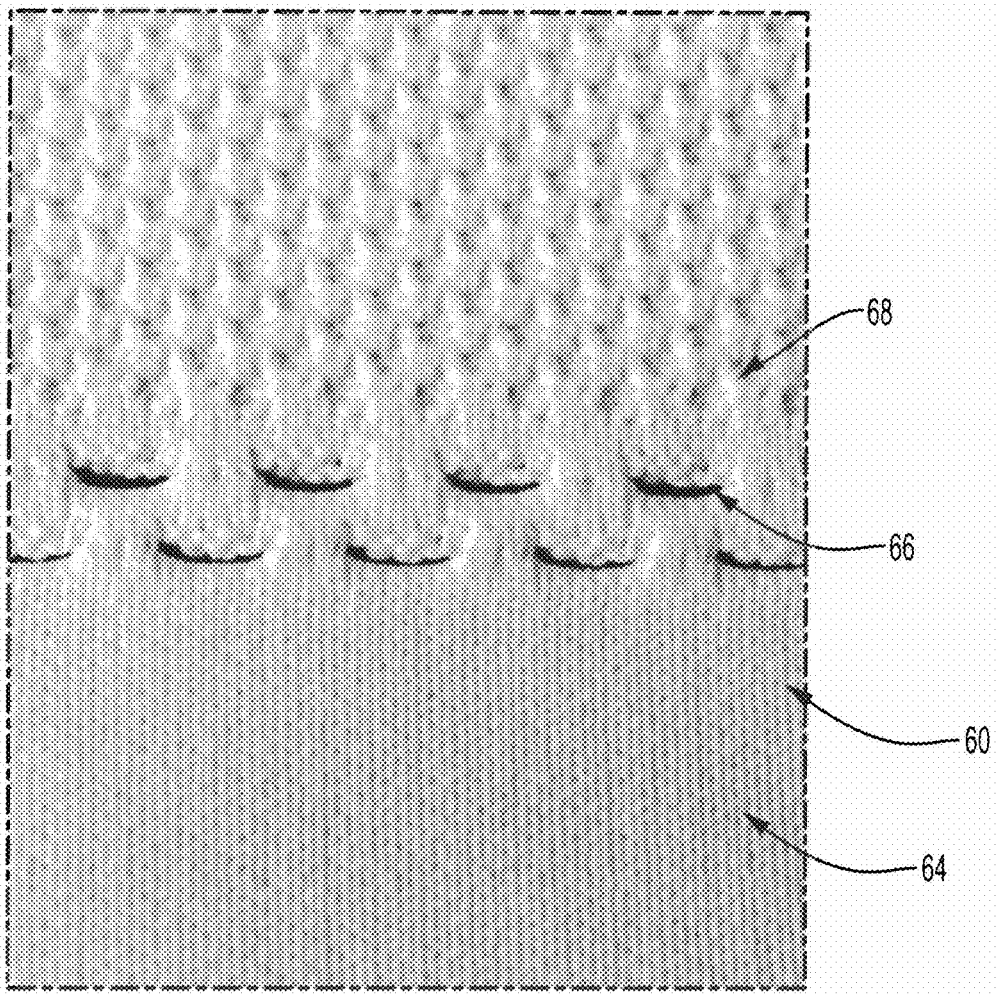
FIG. 9C is a detail view of a third portion of the handbag shown in FIG. 1.

Referring to FIGS. 1 through 9C, a handbag 50 is depicted according to one embodiment. The handbag 50 includes a bottom portion 52 and a sidewall portion 54. The bottom portion 52 generally forms a bottom of the handbag and the sidewall portion 54 generally forms at least a portion of the sides of the handbag 50. In some alternative embodiments, the sidewall portion 54 and other elements together form the sides of the handbag 50. Together, the bottom portion 52 and the sidewall portion 54 at least partially define an interior volume 56 of the handbag 50. The sidewall portion 54 extends up from the bottom portion 52. The sidewall portion 54 extends up from the bottom portion 52 to a top edge 58 of the sidewall portion 54. The top edge 58 of the sidewall portion 54 may also form the top edge of the handbag 50. The sidewall portion 54 is formed from at least a first knitted element 60. In some embodiments, the entirety of the sidewall portion 54 is formed from the first knitted element 60. In alternative embodiments, the sidewall portion 54 may be formed from the at least first knitted element 60 and other knitted or non-knitted elements.

The first knitted element 60 forms the sidewall portion 54 with a second substantially identical knitted element 62. In alternative embodiments, the first knitted element 60 forms the entirety of the sidewall portion 54. The first knitted element 60 is of a unitary one-piece construction and is formed during a knitting process on a knitting machine (not shown). The knitted element 60 includes at least a first knitted region 64 and a second knitted region 66. Each knitted region generally extends upward and/or downward from adjacent knitted regions and laterally between a first edge 65 and a second edge 67 of the knitted element 60. The first knitted region 64 of the first knitted element 60 is seamlessly knitted with the second knitted region 66 of the first knitted element 60. The first knitted region 64 of the first knitted element 60 is of a first type of knit structure different from the second knitted region 66 of the first knitted element 60. For example, and without limitation, the knit structure may differ in one or more of the type of stitch (e.g., jersey stitch, pointelle stitch, or the like), the tightness (e.g., size) of each stitch, or other characteristics. The second knitted region 66 of the first knitted element 60 is of a second type of knit structure different from the first type of knit structure. In some embodiments, adjacent knitted areas are of different knit structure. The handbag 50 may include any number of knitted regions and/or knitted elements. Alternatively, the handbag 50 may include only those knitted regions and/or knitted elements in the depicted embodiment.

Each knitted region is seamlessly knitted with adjacent knitted regions, and each knitted region extends between the first and second edges 65,67. Each knitted region also extends along the Y axis for a height. In some embodiments, each knitted region has a different height along the Y axis. In alternative embodiments, each knitted region has the same height along the Y axis. In still further embodiments, some but not all of the knitted regions have the same height along the Y axis.

The knitted elements 60,62 may be knitted with one or more yarns, such as polyester yarns, nylon yarns, cotton yarns, and spandex yarns. In some embodiments, the knitted elements 60,62 are knitted of polyester covered spandex yarn and hot melt yarn, such that of the finished knitted element, the polyester covered spandex yarn constitutes at least 50% by mass (and more preferably at least 60% by mass and in some embodiments 80% by mass), and the hot melt yarn constitutes at least 15% by mass (and more preferably at least 20% by mass but not more than 30% by mass).

The handbag 50 has a handbag exterior surface 53 and a handbag interior surface 55. At least the first knitted element 60 of the sidewall portion 54 includes a first face and a second face opposite the first face. The first face of the first knitted element 60 forms at least a portion of the handbag exterior surface 53, and the second face of the first knitted element 60 forms at least a portion of the handbag interior surface 55. For example, and without limitation, the "right" side of the first knitted element 60 forms the exterior surface 53 and the "wrong" side of the first knitted element 60 forms the interior surface 55. In some embodiments, the sidewall portion 54 of the handbag 50 does not include additional layers. The first knitted element 60 forms the entirety of at least a portion of the sidewall portion 54 without the presence of other elements (e.g., a liner layer). In alternative embodiments, the handbag 50 may include one or more additional layers such as a liner. The liner (not shown) may form the handbag interior surface.

In the depicted embodiment, the handbag 50 includes both first and second knitted elements 60,62. The first and second knitted elements 60,62 are joined and form the entirety of the sidewall portion 54. The first knitted element 60 is substantially identical to the second knitted element 62 but may vary, for example, due to manufacturing imperfections, features to account for other portions of the handbag (e.g., an interior pouch), or the like.

In the depicted embodiment, the first knitted element 60 includes six knitted regions (i.e., a first knitted region 64, a second knitted region 66, a third knitted region 68, a fourth knitted region 70, a fifth knitted region 72, and a sixth knitted region 74). Each knitted region differs in type of knit structure from adjacent knitted regions and is seamlessly knit with adjacent knitted regions. For example, the second knitted region 66 differs in knit structure type from both the first knitted region 64 and the third knitted region 68, but the fifth knitted region 72 is of the same knit structure type as the second knitted region 66.

The first knitted region 64 is of a knit structure that is more tightly knit than that of the second knitted region 66. The third knitted region 68 is of a knit structure that is more tightly knit than that of the second knitted region 66 and is less tightly knit than that of the first knitted region 64. The fourth knitted region 70 is of a knit structure that is more tightly knit than that of the third knitted region 68. The fifth knitted region 72 is of the same knit structure as the second knitted region 66. The sixth knitted region 74 is of the same knit structure as the first knitted region 64.

For example, and without limitation, the first knitted region 64 is a jersey stitch. The second knitted region 66 is an open pointelle stitch with a stitch size between 5 and 7 millimeters, inclusive. Preferably, the second knitted region 66 has a stitch size of substantially 6 millimeters. The third knitted region 68 is a pointelle stitch with a stitch size of between 2 and 4 millimeters, inclusive. Preferably, the third knitted region 68 has a stitch size of substantially 3 millimeters. The fourth knitted region 70 is a pointelle stitch with a stitch size of between 1 and 3 millimeters, inclusive. Preferably, the fourth knitted region 70 has a stitch size of 2 millimeters. The fifth knitted region 72 is substantially the same stitch type and size as that of the second knitted region 66. The sixth knitted region 74 is substantially the same stitch type as that of the first knitted region 64. The use of jersey stitching for the first knitted region 64 and the sixth knitted region 66 may provide an advantage in that these areas are most likely to be subject to stretching, tearing, or other forces as these areas from the opening to the handbag 50 and the region nearest surfaces on which the handbag 50 will be placed. The tight jersey type stitch may resist these forces better in comparison to other types of stitches.

Still describing the depicted embodiment, each knitted region, first 64 through sixth 74, has a corresponding first through sixth height along the Y axis. The second height is less than the first height. The third height is greater than the first height. The fourth height is less than the third height and greater than the first height. The fifth height is substantially the same as the second height. And, the sixth height is greater than or equal to the second and fifth heights and less than the first height.

In some embodiments, such as the depicted embodiment, two knitted elements 60,62 are joined by a first trim piece 76 and a second trim piece 78. The joined knitted elements 60,62 form at least a portion of the sidewall portion 54 of the handbag 50. The first trim piece 76 is stitched to both the first knitted element 60 and the second knitted element 62 substantially near the first edge 65 of the first and second knitted elements 60,62. For example, and without limitation, the first trim piece 65 is stitched to the first and second knitted elements 60,62 such that the first trim piece 76 overlaps at least a portion of the first and second knitted elements 60,62. The joint between the first and second knitted elements 60,62 is obscured by the first trim piece 76. In some embodiments, the first and second knitted elements 60,62 may also be directly stitched together. The second trim piece 78 is stitched to both the first knitted element 60 and the second knitted element 62 substantially near the second edge 67 in the same manner as the first trim piece 76. In some embodiments, the first and second trim pieces 76,78 extend the height, along the Y axis, of the first and second knitted elements 60,62. In alternative embodiments, the trims pieces 76,78 do not extend for this entire height. The first and second trim pieces 76,78 may also be stitched to the bottom portion 52.

The first and second trim pieces 76,78 and the bottom portion 52 may be one or more of leather, artificial leather, suede, plastic, rubber, or a knit construction. In some embodiments, the handbag 50 further includes additional features and/or structures such as one or more handles 80, a closure mechanism 82, and interior bag 84, or the like.

As previously discussed, the handbag 50 may differ from the depicted embodiment in some alternative embodiments. In some embodiments, the handbag 50 includes only two knitted regions. In alternative embodiments, the handbag 50 includes three or more, four or more, five or more, or six or more knitted regions. At least some of the knitted regions differ from one another in knit structure type. Alternatively, knitted regions may differ in other characteristics such as color. In some embodiments, the handbag 50 does not include trim pieces 76,78, but rather a single knitted element forms the entirety or at least a portion of the sidewall portion 54. The features described herein may be present in varying numbers and types (e.g., the number of knitted regions) or absent (e.g., trim pieces) in different possible embodiments of the handbag 50 without departing from the scope of this disclosure.

Figure 10:
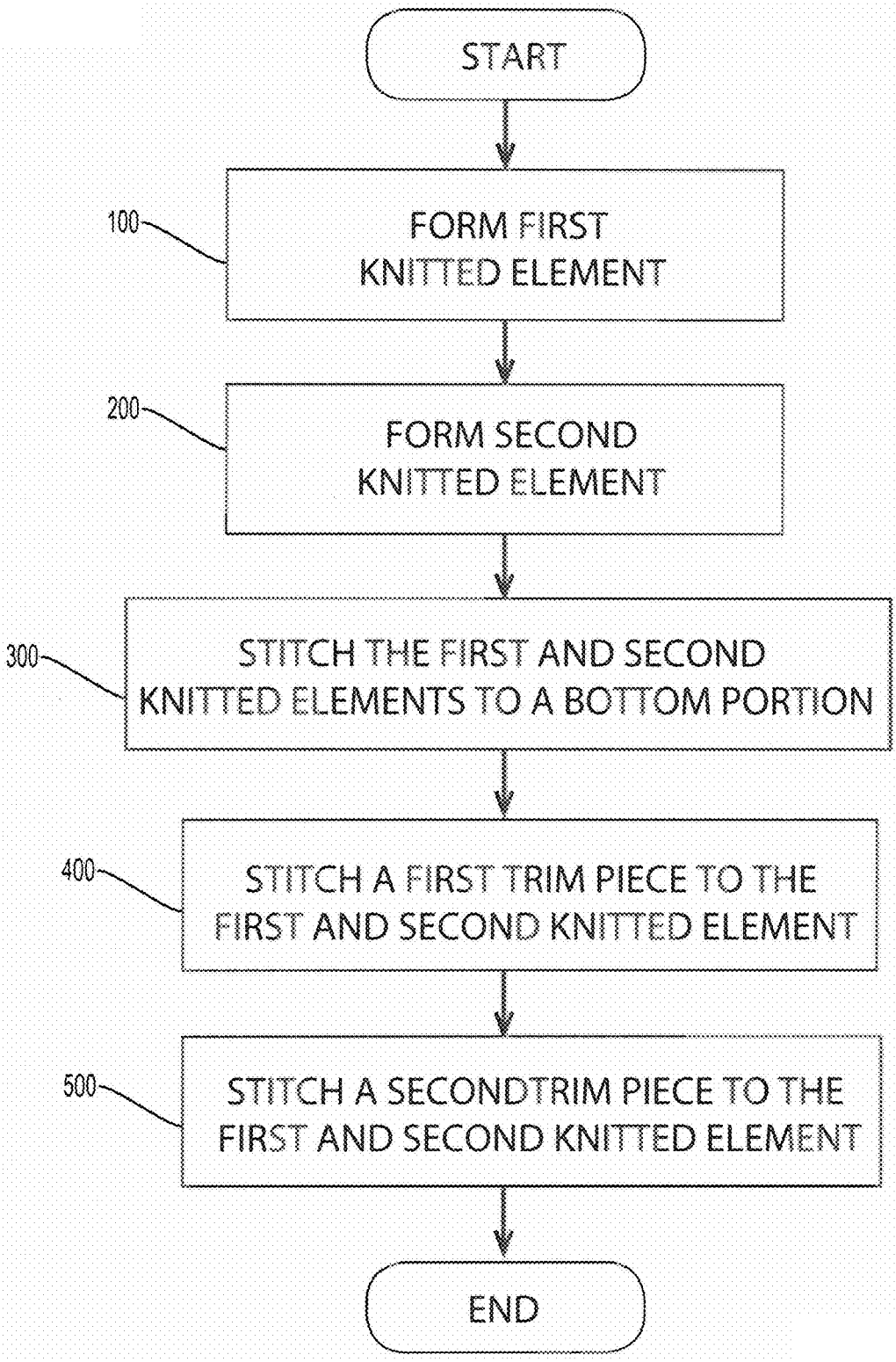
FIG. 10 is a flow diagram of a method of making the handbag of FIG. 1 according to an exemplary embodiment of the present disclosure.

FIG. 10 is a flow diagram of a method of making the handbag of FIGS. 1-9C. In step 100, the first knitted element 60 is formed via a knitting machine, such as a CNC knitting machine, as a unitary one-piece construction. During the knitting step 100, the knitted regions (e.g., the first knitted region 64 and the second knitted region 66) are knitted. By being knitted as a as a unitary one-piece construction, it is to be understood these various regions of the knitted element are formed together via the knitting process, as opposed to the regions being formed separately and then sewn or bonded together. As such, at least the first knitted region 64 and the second knitted region 66 are seamlessly knitted. In step 200, the second knitted element 62 is similarly knitted. In some embodiments, in steps 100 and 200 the knitting is flat knitting. In alternative embodiments, circular knitting is used.

In step 300, the first and second knitted elements 60,62 are stitched to the bottom portion 52 of the handbag 50 (e.g., sewn together). As a result, the bottom portion 52 is stitched to the sidewall portion 54 substantially near a bottom edge of the sidewall portion 54 such that the sidewall portion 54 extends up from the bottom portion 52. Any suitable stitching technique may be used. In some embodiments, the first and second knitted elements 60,62 are aligned prior to step 300 such that the "right" sides of the knitted elements are faced to form at least a portion of the exterior of the handbag 50.

In step 400, the first trim piece 76 is stitched (e.g., sewn) to both the first knitted element 60 and the second knitted element 62 substantially near the first edge 65 of the first and second knitted elements 60,62. For example, and without limitation, the first trim piece 65 is stitched to the first and second knitted elements 60,62 such that the first trim piece 76 overlaps at least a portion of the first and second knitted elements 60,62. The joint between the first and second knitted elements 60,62 is obscured by the first trim piece 76. Any suitable stitching technique may be used.

In step 500, the second trim piece 78 is stitched to both the first knitted element 60 and the second knitted element 62 substantially near the second edge 67 in the same manner as the first trim piece 76.

In some embodiments, the method includes additional steps or eliminates one or more steps described. For example, and without limitation, a single knitted element may be formed and stitched to the bottom portion 52, and no trim pieces are stitched to the single knitted element. The method described herein may be similarly adapted to construct the various embodiments of the handbag 50 described herein.

In view of the foregoing, it will be seen that the several advantages of the disclosure are achieved and attained.

The embodiments were chosen and described in order to best explain the principles of the disclosure and its practical application to thereby enable others skilled in the art to best utilize the disclosed handbag in various embodiments and with various modifications as are suited to the particular use contemplated.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A handbag comprising:

a bottom portion;

a sidewall portion, the sidewall portion extending up from the bottom portion, the sidewall portion comprising at least a first knitted element, the first knitted element being of a unitary one-piece construction formed during a knitting process on a knitting machine, the knitted element comprising at least first, second, and third knitted regions, the first knitted region of the first knitted element being seamlessly knitted with the second knitted region of the first knitted element, the third knitted region of the knitted element being seamlessly knitted with the second knitted region of the knitted element, the first knitted region of the first knitted element being of a first type of knit structure, the second knitted region of the first knitted element being of a second type of knit structure, the third knitted region of the first knitted element being of a third type of knit structure, the second type of knit structure being different from the first type of knit structure, the third type of knit structure being different from the first type of knit structure and different from the second type of knit structure, the first type of knit structure being a jersey stitch, the second type of knit structure being a pointelle stitch, and the third type of knit structure being a pointelle stitch, the third type of knit structure being more tightly knit than the second type of knit structure.

2. The handbag of claim 1 wherein the first type of knit structure is more tightly knit than the second type of knit structure.

3. The handbag of claim 1 wherein the first knitted element comprises hot melt yarn, the hot melt yarn constituting at least 15% by mass of the first knitted element.

4. The handbag of claim 1 wherein the handbag comprises a handbag exterior surface and a handbag interior surface, the first knitted element including a first face and a second face opposite the first face, the first face of the first knitted element comprising at least a portion of the handbag exterior surface, the second face of the first knitted element comprising at least a portion of the handbag interior surface.

5. The handbag of claim 1, the sidewall portion further comprising at least a second knitted element, the second knitted element substantially identical to the first knitted element.

6. The handbag of claim 5 further comprising a first trim piece and a second trim piece, the first trim piece stitched to both the first knitted element and the second knitted element and the second trim piece stitched to both the first knitted element and the second knitted element such that the first and second knitted elements are joined to form the sidewall portion.

7. The handbag of claim 6 wherein the first trim piece and the second trim piece are one or more of leather, artificial leather, suede, plastic, rubber, or a knit construction.

8. The handbag of claim 1 wherein the knitted element comprises a fourth knitted region, the fourth knitted region of the first knitted element being seamlessly knitted with the third knitted region of the knitted element, the fourth knitted region of the first knitted element being of a fourth type of knit structure, the fourth type of knit structure being different from the first, second, and third type of knit structure.

9. The handbag of claim 8 wherein the fourth type of knit structure is a pointelle stitch, the fourth type of knit structure being more tightly knit than the third type of knit structure.

10. The handbag of claim 8 wherein the knitted element comprises a fifth knitted region, the fifth knitted region of the first knitted element being seamlessly knitted with the fourth knitted region of the knitted element, the fifth knitted region of the first knitted element being of the second type of knit structure.

11. The handbag of claim 10 wherein the knitted element comprises a sixth knitted region, the sixth knitted region of the first knitted element being seamlessly knitted with the fifth knitted region of the knitted element, the sixth knitted region of the first knitted element being of the first type of knit structure.

12. The handbag of claim 11 wherein the fourth knitted region is a pointelle stitch, the fifth knitted region is an open pointelle stitch, and the sixth knitted region is a jersey stitch.

13. A handbag comprising:

a bottom portion;

a sidewall portion, the sidewall portion extending up from the bottom portion, the sidewall portion comprising at least a first knitted element, the first knitted element being of a unitary one-piece construction formed during a knitting process on a knitting machine, the knitted element comprising at least three knitted regions, each of the at least three knitted regions being seamlessly knitted with at least another of the at least three knitted regions, a first one of the at least three knitted regions being of a first type of knit structure, a second one of the at least three knitted regions being of a second type of knit structure, and a third one of the at least three knitted regions being of a third type of knit structure, wherein the first type of knit structure is a jersey stitch, the second type of knit structure is a pointelle stitch, and the third type of knit structure is a pointelle stitch, the third type of knit structure being more tightly knit than the second type of knit structure.

14. The handbag of claim 13 wherein the second one of the at least three knitted regions is adjacent the first one of the at least three knitted regions.

15. The handbag of claim 14 wherein the third one of the at least three knitted regions is adjacent the second one of the at least three knitted regions.

16. The handbag of claim 13 wherein the at least three knitted regions comprises at least six knitted regions.

17. The handbag of claim 16 wherein the second one of the at least three knitted regions is adjacent the first one of the at least three knitted regions, and the third one of the at least three knitted regions is adjacent the second one of the at least three knitted regions.

18. The handbag of claim 16 further comprising a fourth knitted region being of a fourth type of knit structure, a fifth knitted region being of the second type of knit structure, and a sixth knitted region being of the first type of knit structure.

19. The handbag of claim 18 wherein the fourth type of knit structure of the fourth knitted region is more tightly knit than the third type of knit structure.

20. A handbag comprising:

a bottom portion;

a sidewall portion, the sidewall portion extending up from the bottom portion, the sidewall portion comprising at least a first knitted element, the first knitted element being of a unitary one-piece construction formed during a knitting process on a knitting machine, the knitted element comprising at least three knitted regions, each of the at least three knitted regions being seamlessly knitted with at least another of the at least three knitted regions, a first one of the at least three knitted regions being of a first type of knit structure, a second one of the at least three knitted regions being of a second type of knit structure, and a third one of the at least three knitted regions being of a third type of knit structure, wherein the first type of knit structure is a jersey stitch, the second type of knit structure is a pointelle stitch, and the third type of knit structure is a jersey stitch, the third one of the at least three knitted regions being spaced from the first one of the at least three knitted regions.

21. The handbag of claim 20 wherein the second one of the at least three knitted regions is adjacent the first one of the at least three knitted regions.

22. The handbag of claim 21 wherein the third one of the at least three knitted regions is adjacent the second one of the at least three knitted regions.

23. The handbag of claim 20 wherein the at least three knitted regions comprises at least six knitted regions.

24. The handbag of claim 22 wherein each of the at least six knitted regions is seamlessly knitted with at least another of the at least six knitted regions.

25. A method of constructing a handbag, the method comprising:

attaching a bottom portion to a sidewall portion substantially near a bottom edge of the sidewall portion such that the sidewall portion extends up from the bottom portion, the sidewall portion comprising at least a first knitted element, the first knitted element being of a unitary one-piece construction, the knitted element comprising at least a first knitted region, a second knitted region, and a third knitted region, the first knitted region of the first knitted element being seamlessly knitted with the second knitted region of the first knitted element, the third knitted region of the knitted element being seamlessly knitted with the second knitted region of the knitted element, the first knitted region of the first knitted element being of a first type of knit structure, the second knitted region of the first knitted element being of a second type of knit structure, the third knitted region of the first knitted element being of a third type of knit structure, the second type of knit structure being different from the first type of knit structure, the third type of knit structure being different from the first type of knit structure and different from the second type of knit structure, wherein the first type of knit structure is a jersey stitch, the second type of knit structure is a pointelle stitch, and the third type of knit structure is a pointelle stitch, the third type of knit structure being more tightly knit than the second type of knit structure.

26. A method in accordance with claim 25 further comprising forming the first knit element during a knitting process on a knitting machine.

27. A method in accordance with claim 26, wherein forming the first knit element comprises flat knitting the first and second knitted regions of the knit element from a yarn including a mixture of hot melt yarn and covering yarn.

28. A method in accordance with claim 25 further comprising:

attaching the bottom portion to a second knitted element of the sidewall portion;

attaching a first trim piece to both the first knitted element and the second knitted element; and attaching a second trim piece to both the first knitted element and the second knitted element such that the first and second knitted elements are joined to form the sidewall portion.

29. A method in accordance with claim 25 wherein the sidewall portion includes a first face and a second face opposite the first face, the first face of the first knitted element comprising at least a portion of a handbag exterior surface, the second face of the first knitted element comprising at least a portion of a handbag interior surface.

* * * * *